US007398574B2

(12) United States Patent
Christ

(10) Patent No.: US 7,398,574 B2
(45) Date of Patent: Jul. 15, 2008

(54) METHOD AND APPARATUS FOR TREATING ROPELIKE TEXTILE GOODS

(75) Inventor: Wilhelm Christ, Bilz (DE)

(73) Assignee: Then Maschinen (B.V.I.) Limited, Tortola (VG)

( * ) Notice: Subject to any disclaimer, the term of this patent is extended or adjusted under 35 U.S.C. 154(b) by 235 days.

(21) Appl. No.: 11/303,501

(22) Filed: Dec. 17, 2005

(65) Prior Publication Data

US 2006/0150343 A1 Jul. 13, 2006

(30) Foreign Application Priority Data

Dec. 20, 2004 (DE) ..... 10 2004 061 186

(51) Int. Cl.
*D06D 5/02* (2006.01)

(52) U.S. Cl. ..... 8/152; 68/178; 68/179

(58) Field of Classification Search ..... 8/152; 68/177, 178, 179

See application file for complete search history.

(56) References Cited

U.S. PATENT DOCUMENTS 3,718,012 A * 2/1973 Vinas ..... 68/9
3,952,558 A * 4/1976 Sandberg et al. ..... 68/177
3,982,411 A * 9/1976 Kreitz ..... 68/177
4,006,612 A * 2/1977 Thies ..... 68/177
4,036,038 A * 7/1977 Aurich et al. ..... 68/5 C
4,114,407 A * 9/1978 Turner et al. ..... 68/178
4,129,017 A * 12/1978 Greer ..... 68/15
4,885,814 A * 12/1989 von der Eltz et al. ..... 8/149.1
5,014,525 A * 5/1991 Bene ..... 68/20
5,014,526 A * 5/1991 Hacker et al. ..... 68/178
5,129,242 A * 7/1992 Sturkey et al. ..... 68/178
5,243,840 A * 9/1993 Grafen et al. ..... 68/62
5,431,031 A * 7/1995 Vinas ..... 68/5 D
5,577,282 A * 11/1996 Turner et al. ..... 8/152

(Continued)

FOREIGN PATENT DOCUMENTS

DE 41 19 152 A1 12/1992

(Continued)

OTHER PUBLICATIONS

WIPO WO 95/08662 Mar. 1995.*

(Continued)

*Primary Examiner*—Frankie L. Stinson
(74) *Attorney, Agent, or Firm*—Robert P. Michal; Frishauf, Holtz, Goodman & Chick, P.C.

(57) ABSTRACT

In a method for treating ropelike textile goods in a closed container that contains at least two axially adjacent J-boxes for receiving textile goods during at least part of the treatment time, a driving motion in a feeding direction is imparted to the textile goods, by means of a gaseous flow of feeding medium made to act on the rope via feed nozzle means. The textile goods, before entering each J-box, pass through separate feed nozzle means assigned to that J-box. Upon exiting from these feed nozzle means, the textile goods are introduced selectively into the respective associated first J-box or a second J-box adjacent to this J-box, or in the case of at least one J-box are conducted along a predetermined path, which carries the textile goods away from this J-box.

29 Claims, 6 Drawing Sheets

U.S. PATENT DOCUMENTS

Figure 1:
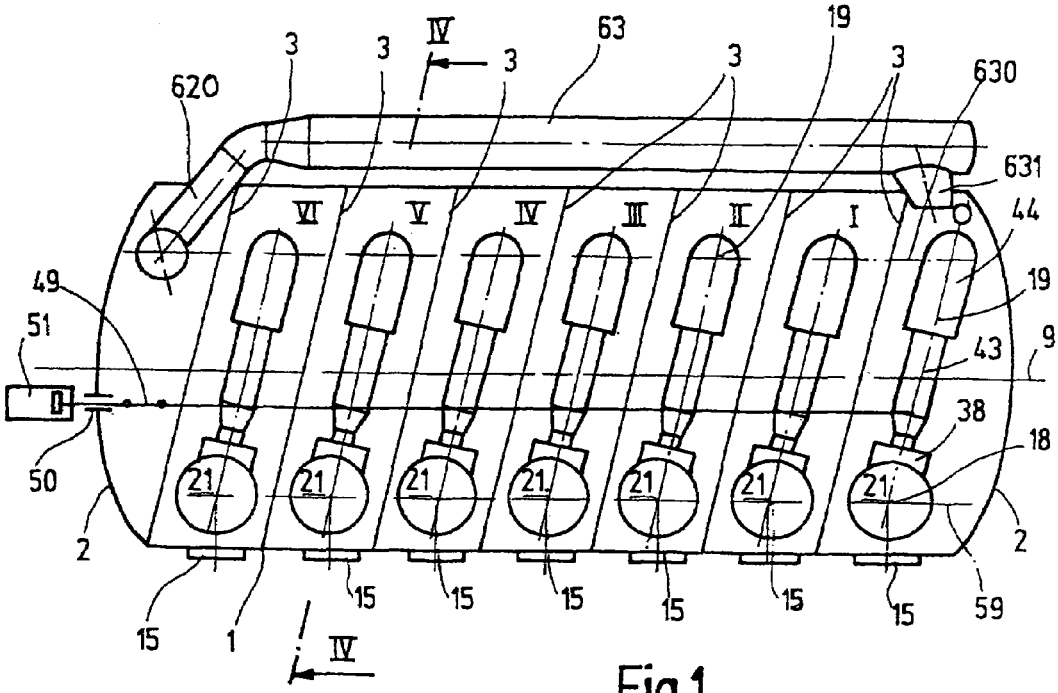

| | | | | |
|---|---|---|---|---|
| 5,642,548 | A * | 7/1997 | Osbourn | 8/152 |
| 5,826,289 | A * | 10/1998 | Catallo | 8/152 |
| 6,199,411 | B1 * | 3/2001 | Schenck et al. | 68/22 R |
| 6,427,495 | B1 * | 8/2002 | Berlendis | 68/152 |
| 6,826,931 | B2 * | 12/2004 | Catallo | 68/9 |

FOREIGN PATENT DOCUMENTS

| | | | |
|---|---|---|---|
| DE | 198 13 593 | A1 | 10/1999 |
| DE | 600 10 445 | T2 | 5/2005 |
| JP | 60-199965 | * | 10/1985 |

OTHER PUBLICATIONS

European Search Report dated Jun. 6, 2007 in corresponding European Patent Application No. 05025396.2.

* cited by examiner

METHOD AND APPARATUS FOR TREATING ROPELIKE TEXTILE GOODS

The invention relates to a method and an apparatus for treating ropelike textile goods or lengths of fabric in a closed container which contains at least two axially adjacent J-boxes for receiving textile goods during at least part of the treatment time. A driving motion in a feeding direction is imparted to the textile goods by means of a gaseous flow of feeding medium that is made to act on the rope or length of fabric via feed nozzle means.

Jet treatment systems operating in accordance with this so-called aerodynamic system, that is, jet or nozzle dyeing machines, are in use in the industry in manifold embodiments. They differ from the hydraulic jet treatment machines in principle in that the feeding means acting on the feed nozzles is not the treatment liquor but rather a gaseous feeding means. Accordingly, the conditions in hydraulic jet treatment machines cannot readily be adopted for jet or nozzle treatment systems that operate on the aerodynamic principle. Examples of jet treatment machines on the aerodynamic principle are described for instance in European Patent Disclosure EP 0 133 897 and German Patent DE C2 198 13 593, to name only some. As DE C2 198 13 593 teaches, treatment apparatuses of this type are known in which at least two J-boxes located axially side by side are provided in the closable treatment container, each J-box being intended to receive its own endless rope, which is set into circulation by feed nozzle means associated with the J-box and which is flat-folded at the outlet from the feed nozzle means, or in other words on entering the J-box. The feed nozzles of the parallel-operation J-boxes located side by side communicate with the compression side of a common blower, which aspirates a mixture of vapor and air from the treatment container and feeds it as a feeding medium into the feed nozzles. When there is a plurality of J-boxes axially side by side, special precautions must be made in the feeding medium distribution conduits so as to attain an at least approximately uniform action by the feed nozzles of the individual J-boxes.

In another apparatus, known from German Patent DE C2 41 19 152, for wet treatment of textile material in the form of an endless rope, which in one version has a plurality of J-boxes, distributed over the length of the treatment container, and thus makes it possible to treat a corresponding number of endless ropes of textile independently of one another simultaneously, the arrangement is made such that each J-box is followed, on the goods outlet side, by a deflection roller and an adjoining feed nozzle, embodied as a ring nozzle, whose rope outlet opens into the same J-box. A guide tube leading into the J-box is connected to the outlet side of the feed nozzle and is pivotable about a vertical axis and can execute a traversing motion for flat folding the rope. Each of the feed nozzles is subjected to the gaseous feeding medium by means of its own radial blower; this feeding medium is aspirated from the interior of the treatment container through an aspiration opening on the bottom in the housing of the radial blower and is introduced into the feed nozzle through a tangential air-blast opening. Each radial blower is inserted with a vertical axial orientation into a top opening in the jacket of the treatment container.

With this apparatus, only single-rope treatment can be done.

The object of the invention is to increase the manifold nature of treatment options for ropelike textile goods by the above-mentioned aerodynamic principle, providing the capability of simple structural implementation while attaining advantages in terms of the method.

For attaining this object, the method of the invention has the characteristics of claim 1. An apparatus according to the invention is the subject of claim 6.

In the novel method, the ropelike textile goods, before entering each J-box, are passed through separate feed nozzle means assigned to this J-box, and on exiting from these feed nozzle means are introduced selectively into the J-box respectively associated with these feed nozzle means or into a J-box adjacent to that J-box, or when there is at least one J-box are carried along a predetermined path, which carries the textile goods away from this J-box. In each J-box, its own endless rope can be kept in circulation during at least part of the treatment time, or alternatively, an endless rope from one J-box each can be carried into a J-box adjacent to it and after passing through that J-box and optionally through at least one further J-box can be returned to the first J-box, and the endless rope is set into circulation by the feeding means, through which it passes, of the individual J-boxes.

Accordingly, in the novel apparatus, each J-box is assigned its own feed nozzle means, and the feed nozzle means are embodied adjustably, such that their rope outlet leads selectively into the respective associated first J-box, or into a second J-box adjacent to the first J-box, or from at least one J-box into a device that receives the emerging rope. The feed nozzle means of each J-box are advantageously assigned their own blower, and especially simple conditions are obtained if the blower is disposed with a substantially vertical impeller axis, and the blower impeller axes for all the J-boxes are located in at least one common, substantially vertical plane. In a preferred embodiment, the feed nozzle means of the individual J-boxes are supported pivotably about axes of rotation parallel to one another, and the apparatus has a pivoting device which is coupled to the feed nozzle means of the J-boxes and by which the feed nozzle means are pivotable.

The apparatus may have a rope returning device, which is arranged for receiving the rope emerging from the rope outlet of the feed nozzle means of at least one J-box, and by which a rope return path to a J-box preceding it in the rope feeding direction is embodied.

According to the invention, the J-boxes (storage units) can thus be connected parallel with to one another, so that a single-rope treatment, as in currently usual jet treatment machines, can be performed. However, the J-boxes may also be selectively connected in line with one another, making savings possible in terms of the consumption values of current, heat and water, as well as higher power values compared to single-rope treatment.

Connecting the storage units one after the other also leads to savings and shorter loading times in batch preparation and in loading the treatment container with textile goods, since a plurality of boxes can be loaded parallel in a series circuit, and for the entire batch only a small number of seams with which the individual ropes are joined together is required. For instance, in an apparatus in which there are six boxes in the treatment container, three J-boxes connected in line with one another can be loaded at a time in parallel, and for the entire batch, with these six boxes, only two seams in the textile rope are required.

Depending on the treatment method performed and on the size of the apparatus and the number of J-boxes, connecting the J-boxes in line with one another can be used as a circulation system for circulating rope, or as a continuing system with an entering and exiting rope. In this mode of operation of the apparatus, not only dyeing processes and so forth be performed for the textile goods, but also washing and bleaching processes, and, if the treatment container is subdivided into treatment zones by partitions, which over a portion of their circumference adjoin the inner wall of the treatment container in a sealed manner, of which each treatment zone contains at least one J-box, a more-differentiated course of the method can be established in the treatment zones and in the J-boxes contained in them. For instance, by means of rinsing and washing liquor baths on the counter current principle, the need for rinsing water can be reduced to only about 40% of what is needed in single-rope treatment.

Further features and modifications of the invention are the subject of dependent claims.

Figure 2:
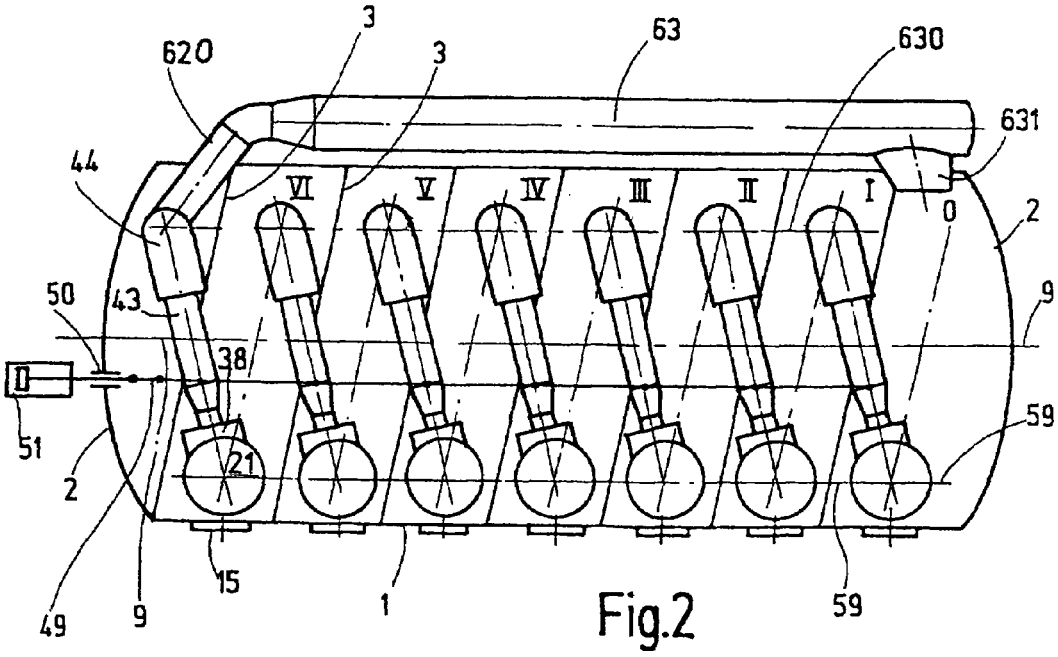
Figure 3:
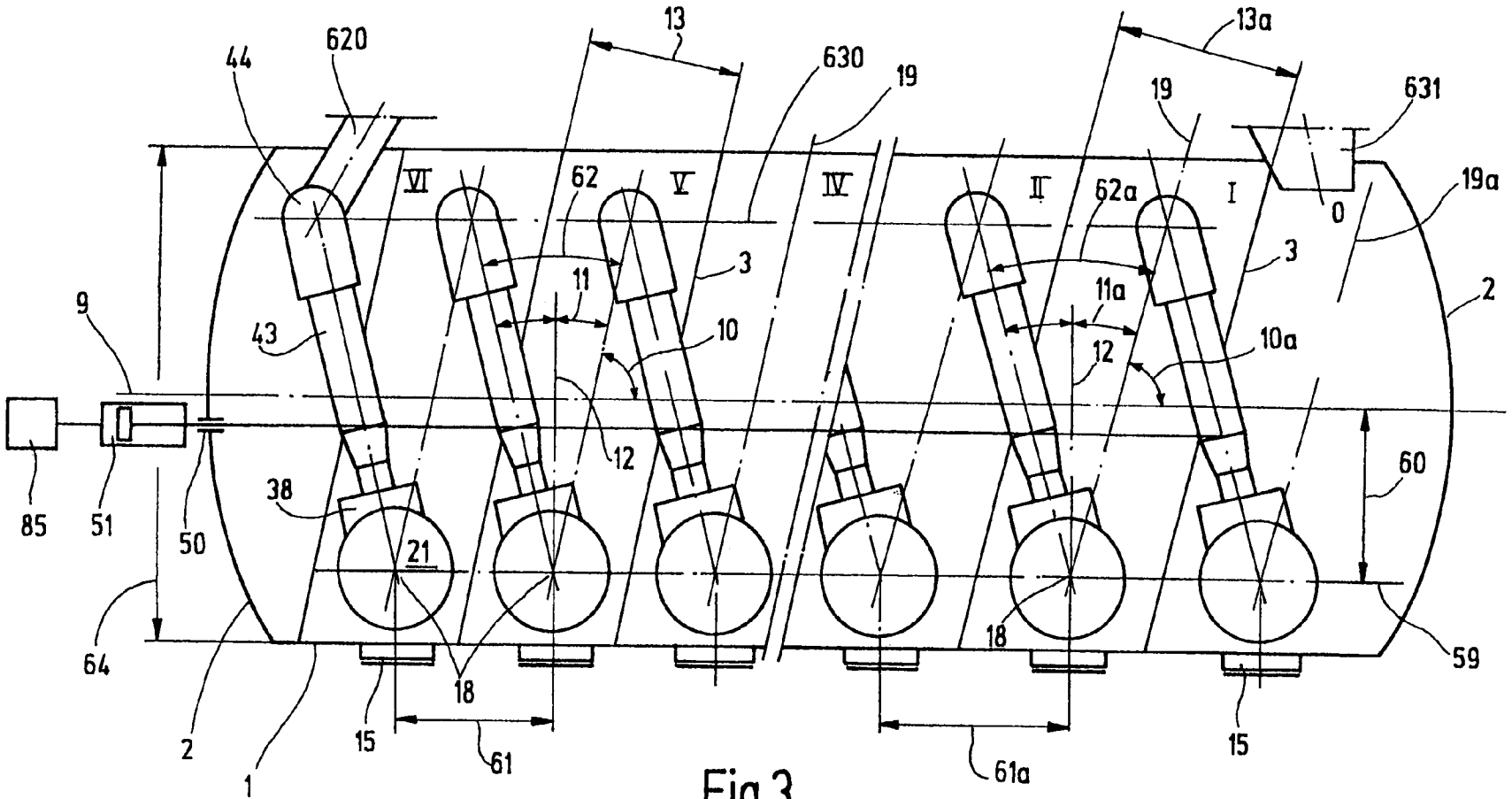
Figures 4, 5:
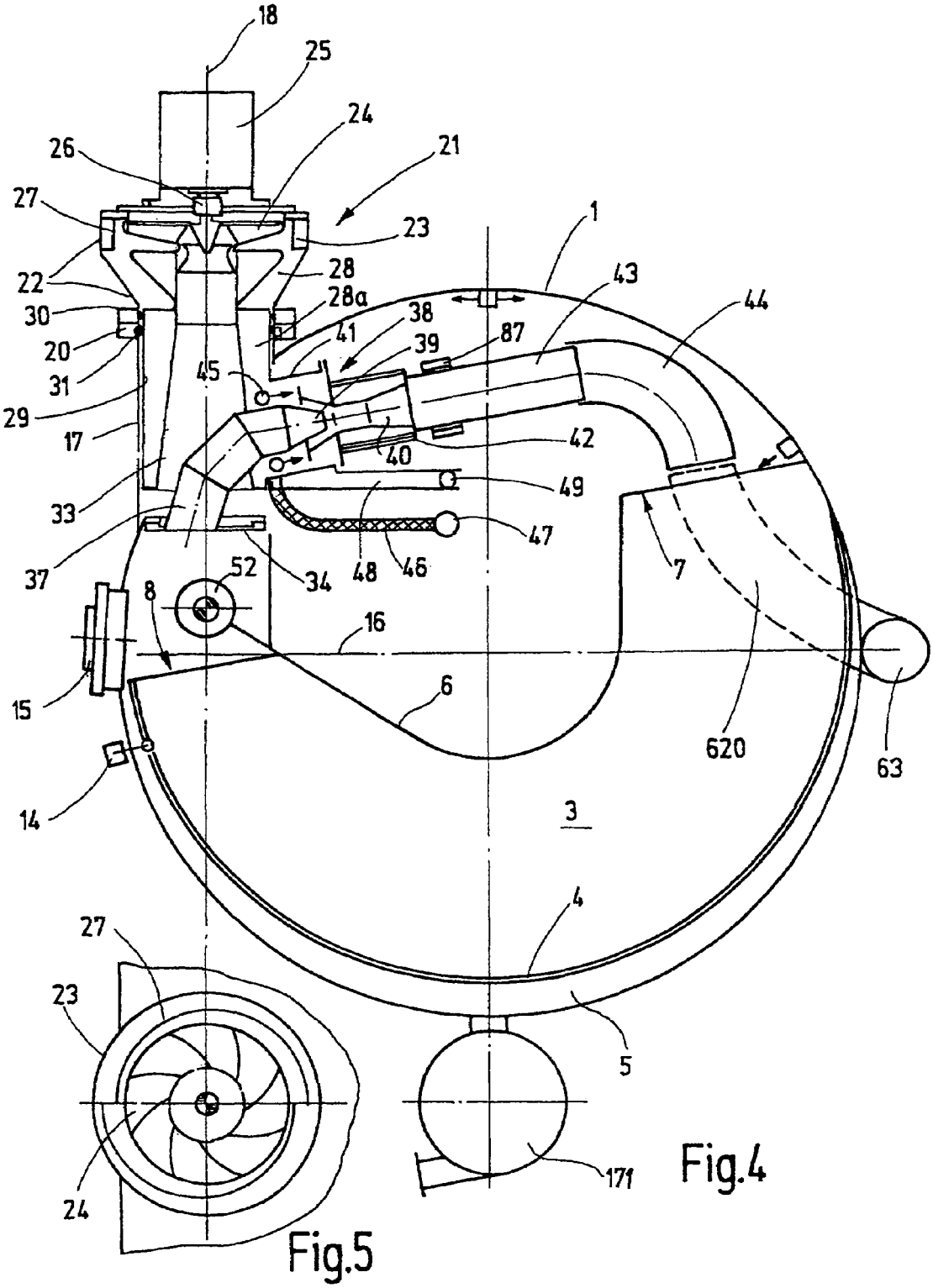
Figure 6:
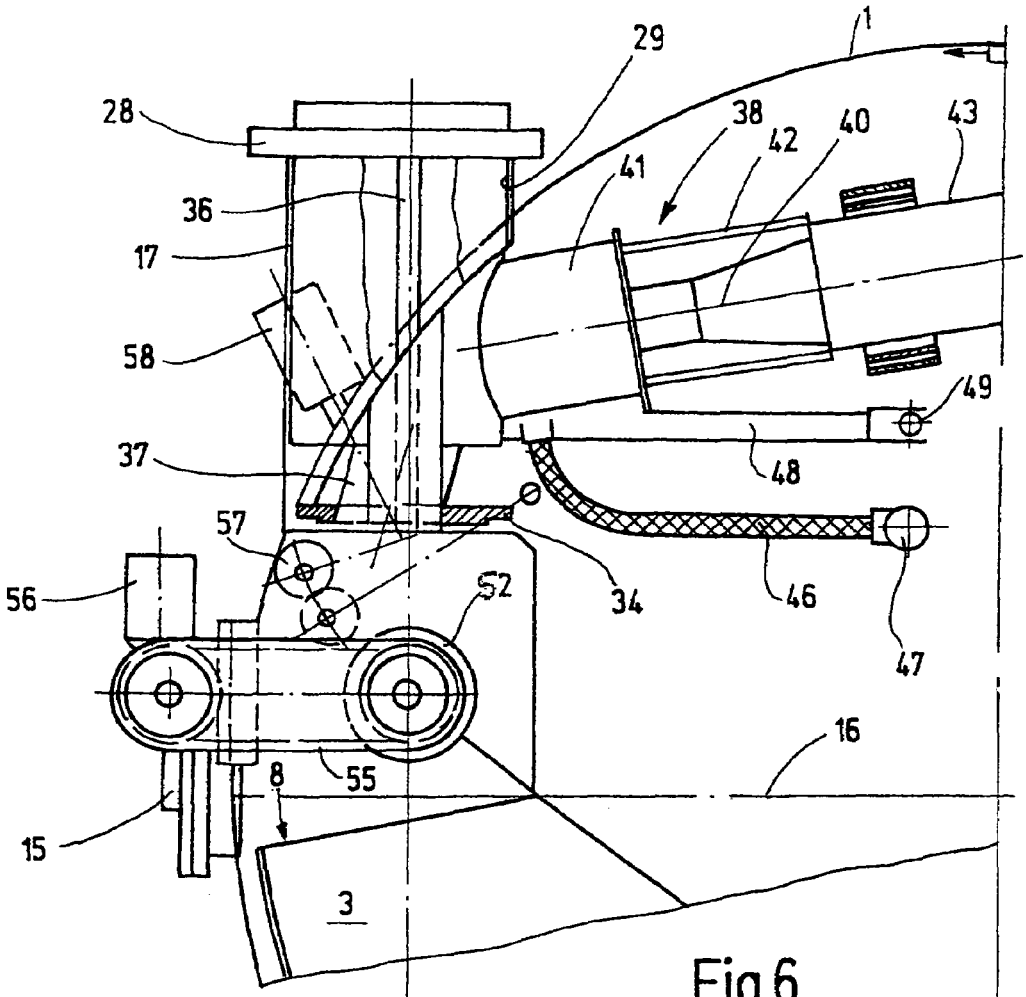
Figure 7:
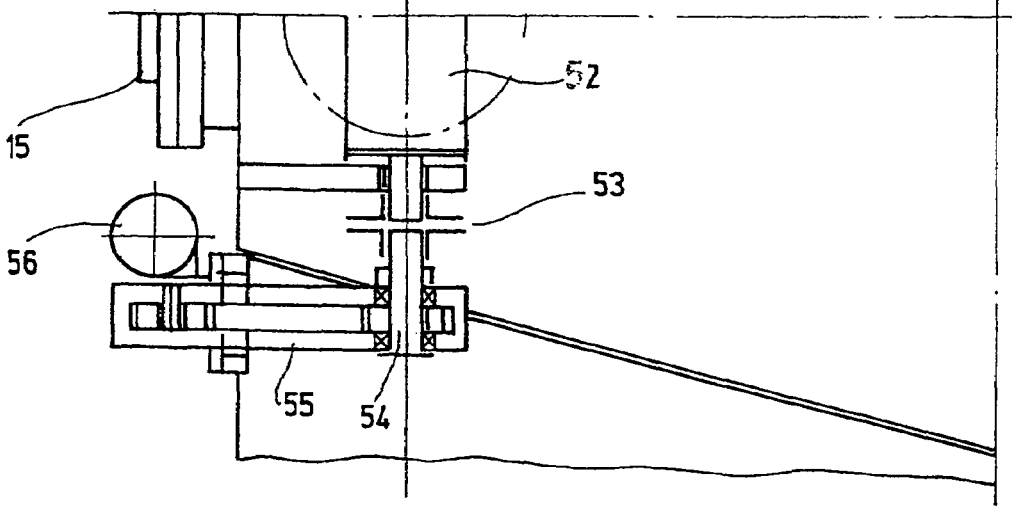
Figure 8:
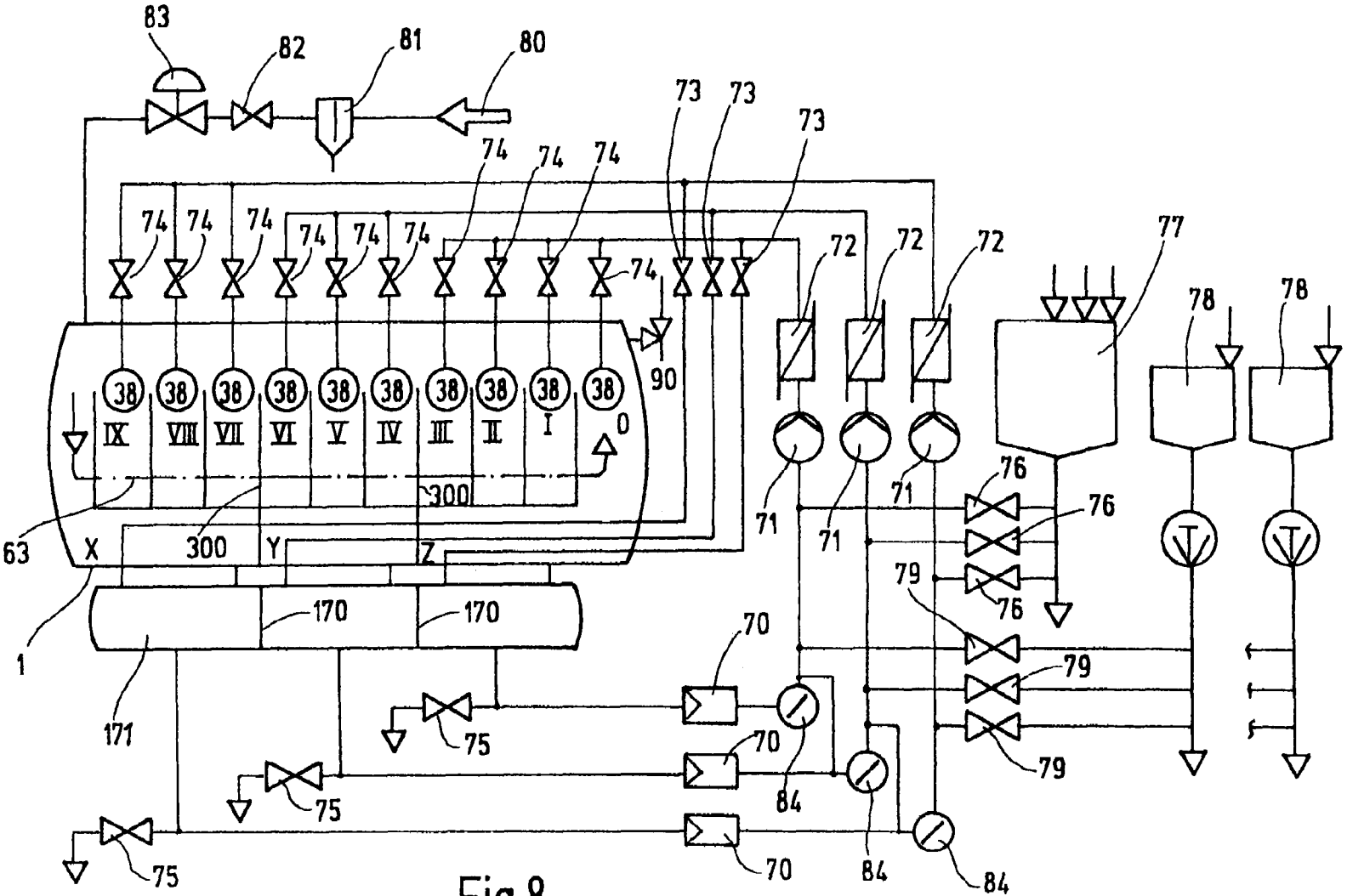
Figure 9:
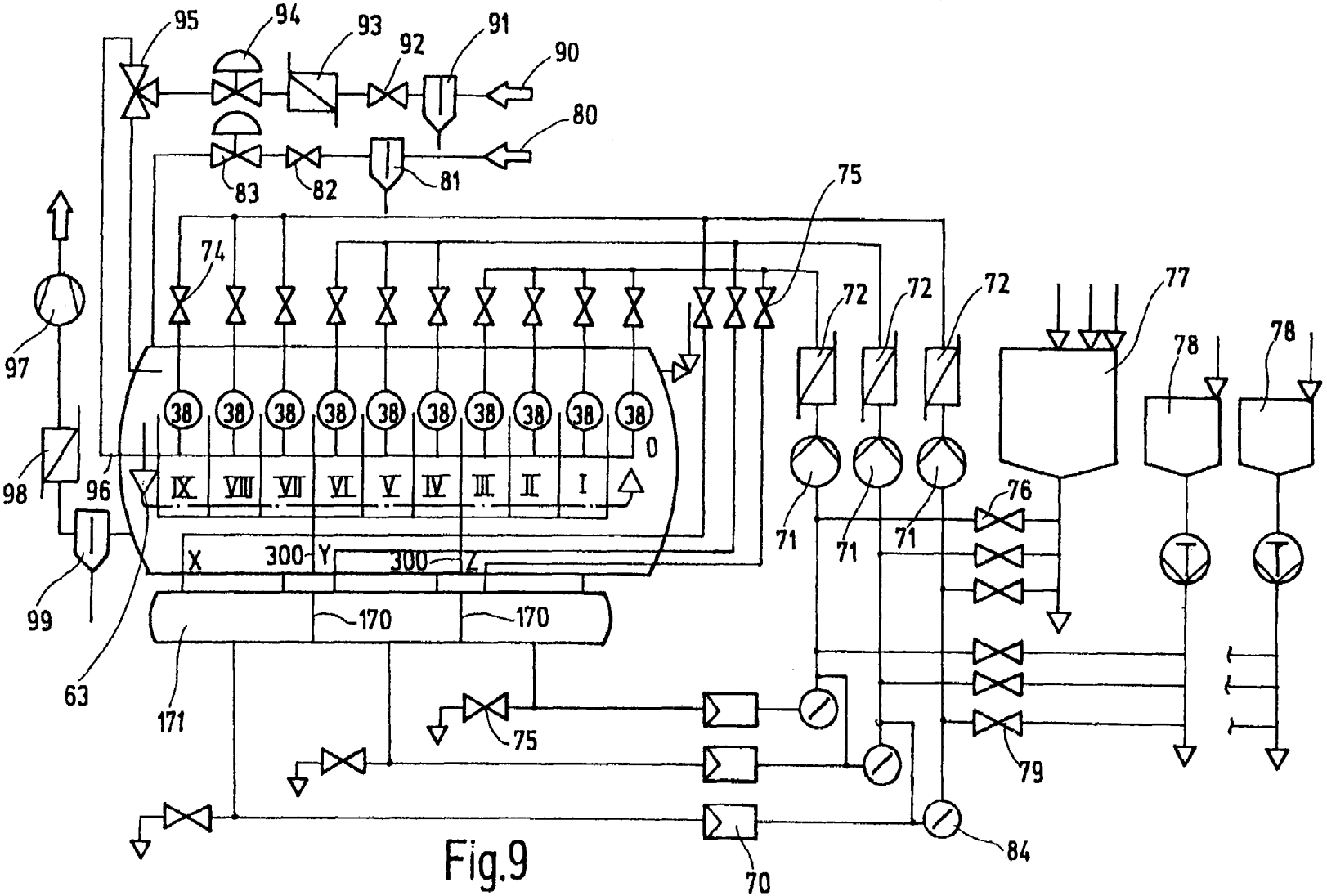

In the drawings, four exemplary embodiments of the subject of the invention are shown, as follows:

FIG. 1 in longitudinal section and schematically shows an apparatus according to the invention in the form of a high-temperature piece-dyeing machine, with the J-boxes connected parallel;

FIG. 2, in a corresponding schematic sectional view, shows the apparatus of FIG. 1 with the J-boxes connected in series;

FIG. 3, in a sectional view corresponding to FIG. 2, is a detail of the apparatus of FIG. 2, showing the angle relations in terms of the disposition of the J-boxes and of the pivoting region of the feeding segments of the individual blowers;

FIG. 4, in a section taken along the line IV-IV in FIG. 1, shows the apparatus of FIG. 1 in a simplified, schematic side view;

FIG. 5 is a detail of the apparatus of FIG. 4, showing a plan view on the blower from the side of the blower impeller;

FIG. 6, in a schematic sectional view corresponding to FIG. 4 of a detail of the apparatus of FIG. 4, shows the rope inlet into the feed nozzle and an exemplary embodiment for driving or free-wheeling of the deflection roller;

FIG. 7 is a simplified plan view of a detail of the apparatus of FIG. 6, showing the drive and free-wheeling of the deflection roller;

FIG. 8, in a schematic sectional view corresponding to FIG. 2, shows the apparatus of FIG. 2 in a modified embodiment as a high-temperature piece-dyeing machine, with nine J-boxes connected in series for circulation or for continuous operation and with a circuit of the rinsing and washing baths on the counter current principle, showing the essential auxiliary devices for carrying out the method; and FIG. 9 is a corresponding sectional view of the apparatus of FIG. 7, with supplementary devices for reducing the moisture in the goods after the wash treatment.

FIGS. 1 through 7 show an apparatus according to the invention, in the form of a high-temperature piece-dyeing machine, with a treatment container 1, embodied as a cylindrical boiler, which is closed in pressuretight fashion on both face ends by welded-on dished boiler heads. In the exemplary embodiment shown in FIGS. 1, 2, six J-boxes are provided in the treatment container 1 and are identified by I through VI. Each J-box I through VI is defined by two parallel side walls 3 and one bottom wall 4, which is joined to the side walls 3, as can be seen for instance from FIGS. 1 and 4. The bottom wall 4 is embodied as a sliding bottom by means of parallel PTFE rods, or by being designed with PTFE tiles, in a manner known per se; both versions permit excess treatment liquor to flow out into the chamber, marked 5 in FIG. 4, beneath the bottom wall 4 in the treatment container 1. The side walls 3, also called fabric boundary walls, are each embodied on their inside with a PTFE coating or are embodied as solid plate parts in guide profiles, such that just as with the bottom wall 4, a friction-reducing arrangement is obtained. Joined to the side walls 3 is an inner cover 6 (FIG. 4), so that the J-box has a substantially U-shaped design, with a rope inlet opening 7 and a rope outlet opening 8. The J-boxes I through VI, in the embodiment shown, each have the same axial J-box width, which for a treatment container diameter of 2200 mm can typically amount to 800 mm.

As can be seen from FIGS. 1 through 3, the side walls 3 of the adjacent J-boxes I through VI extend obliquely relative to the longitudinal axis, indicated at 9, of the treatment container, such that in plan view they form an angle 10 with the longitudinal axis of the treatment container, corresponding to which is a supplementary angle 11 to a transverse plane, indicated at 12 and extending perpendicular to the jacket wall of the container and to the longitudinal axis 9 of the treatment container. In a practical version, the angle 11 is on the order of magnitude of about 12.5° to 15°, but depending on the dimensions of the treatment container 1 and on the axial J-box width shown in FIG. 3 at 13 and 13*a*, still other angle values are possible, as will be described in detail hereinafter.

On the rope outlet side, for each J-box I through VI, there is one fill level sensor 14 (FIG. 4), located somewhat below the rope outlet opening 8; it outputs signals for limiting the rope in the respective J-box.

A loading and unloading opening, which is closed with a removable, pressuretight stopper 15, which is located approximately at the level of the horizontal diameter plane 16 of the treatment container 1. On the underside of the treatment container 1, a liquor pickup container 171 is provided; it communicates with the interior of the container and is intended to pick up the treatment agent (fluid) as the fluid leaves the textile goods. The contents of the liquor pickup container 171 is such that the total quantity of liquor, minus the proportion of liquor that is entrained with the textile goods, can be held, without there being contact between the goods being moved in the respective J-box and the surface of a liquor located outside the goods; this condition also applies for liquor formulations added later.

Spaced apart from and above the rope outlet opening 8, a cylindrical socket connector 17 welded to the jacket of the treatment container 1 leads into the container interior for each J-box I through VI; this stub is oriented vertically with its axis 18 and is located in the center plane of symmetry, shown at 19 in FIG. 3, of the associated J-box. The socket connector 17 has an annular flange 20 on its end, and a blower unit 21 is mounted on this flange. The blower unit 21 has an upper housing part 22 with an impeller housing 23, which contains a radial blower impeller 24 that circulates about the vertical axis of rotation 18 and is coupled with an electric motor 25 mounted on the upper housing part 22. The electric motor 25 is a rotary current motor whose rotary speed can be regulated for inverter operation and which is designed for regulating whatever feed flow is required. Its shaft is sealed off from the housing interior by a shaft seal 26. A spiral guide baffle 27 (FIG. 5) is located in the blower housing 23 and diverts the gaseous medium, pumped by the blower impeller 24, into an outer flow conduit 28, coaxial with the axis of rotation 18, that establishes a communication on the compression side with the impeller housing 23.

In the socket connector 17 that forms the lower housing part of the blower unit 21, a cylindrical inner jacket 29, inserted with slight radial spacing, is supported rotatably; it is oriented coaxially with the axis of rotation 18. The inner jacket 29 is sealed off peripherally from the annular flange 20 via a sealing lip, embodied for instance as a slotted cuff, and is supported radially rotatably and axially suspended on the annular flange via a flat PTFE profile 31. Extending coaxially to the axis of rotation 18 in the jacket 29 is an inner flow conduit 33, provided with a suction cone, that as a suction conduit leads to the blower impeller inlet and on its diametrically opposed end opens into the interior of the treatment container 1. The inner flow conduit 33, with the jacket 29, defines a cylindrical extension 28*a* of the outer flow conduit 28. Thus in the blower unit 21, two centrally located, vertical flow conduits 28, 28*a*; 33 are embodied; the flow conduit 33 acting as a suction conduit is designed conically and is closed off at the bottom (FIG. 4) from the inner jacket 29.

The blower unit 21 can be removed as a whole from the annular flange 22 and replaced as needed with a blower unit of different power or with a different pumping characteristic. Since the socket connector 17 and the annular flange 20 embodied as a welded-on flange remain the same, when a blower unit is replaced only the blower impeller 24 and the impeller 23 have to be graduated in different sizes.

A concentric bearing ring 34 is connected in a manner fixed against relative rotation, via a profile 36 (FIG. 6), to the rotatably supported jacket 29 and carries the tubular fabric inlet part 37 of a feed nozzle 38 embodied as an annular nozzle. The fabric inlet part 37 leads to an inlet nozzle part 39, which with a diffusor 40, in a manner known per se, defines an annular gap which is located in a nozzle housing 41 that is welded to the inner jacket 29 and communicates with the outer flow conduit 28, subjected to pressure by feeding medium. Adjoining the nozzle housing 41 is a support housing 42, secured to it by means of a suitable stopper, for a PTFE feeding tube 43 which is coaxial with the nozzle part 39 and into which the diffusor 40 discharges. The housing 42 forms a rigid support construction, secured against relative rotation, for the adjoining feeding tube 43, onto which an inlet curve 44 of larger diameter is placed that together with the feeding tube 43 forms a feeding segment and can introduce an exiting rope into a J-box, for instance, as will be described in detail hereinafter. The feeding tube 43, in the exemplary embodiment shown in FIG. 4, rises slightly at an angle of about 10° to the horizontal. Its inlet curve 44 discharges at a slight spacing from the edge of the J-box inlet opening 7.

Injection nozzles 45 discharge into the cylindrical nozzle housing 41, distributed annularly about its axis, and communicate, via a flexible hose 46 of PTFE and special steel cloth, with a treatment agent feed line 47. The injection nozzles 45 act as atomizer nozzles in the direction of the annular gap embodied between the nozzle part 39 and the diffusor 40, so that a uniform action by the treatment agent injection flow on the rope passing through the feed nozzle 38 is achieved.

A cantilevered arm 48 is secured to the underside of the nozzle housing 41 and is connected in articulated fashion to a thrust rod 49, which as can be seen from FIG. 1, for example, extends over the axial length of the treatment container 1 and is passed, sealed off at 50, through a dished boiler head 2. The thrust rod 49 communicates with a pneumatic lifting cylinder 51, which may also be replaced by a threaded spindle or some other actuating drive. Actuation of the lifting cylinder 51 thus causes pivoting of the feed nozzle 38 and of the feeding segment 43/44 about the vertical axis of rotation 18 of the blower unit. Since as FIGS. 1 and 2 show, for example, the thrust rod 49 is coupled with the cantilevered arms 48 of all the blower units 21, upon actuation of the lifting cylinder 51 the feed nozzles and feeding segments for all the J-boxes are simultaneously pivoted by the same angle about their respective vertical pivot axis 18; hence they are rigidly coupled to one another. The same is also true for the feed nozzle 38 and the feeding segment 43/44 of a further blower unit 21, which is located in an intermediate storage chamber, identified by 0 in FIGS. 1 and 2 and is defined on one side by a dished boiler head 2, as will also be explained hereinafter.

Below the fabric inlet part 37 of each feed nozzle 38, in the treatment container 1, there is a deflection roller 52, supported in free-wheeling fashion about a horizontal axis; the deflection roller 52 can selectively extend continuously along all the J-boxes in the treatment container, or each J-box or each group of J-boxes may be provided with its own deflection roller 52. Each deflection roller 52, as FIG. 7 shows, is coupled with a toothed belt drive 54, located in the treatment container 1 and embodied for instance as a magnetic coupling, whose toothed belt 55, secured with a guard baffle, is extended to the outside of the treatment container 1 and is driven by a geared motor 56. As a rule, the deflection roller 52 has a smooth surface. It is assigned a rotary-speed monitoring device, which enables monitoring the rope travel. The deflection roller 52, as FIG. 4 illustrates, makes secure fabric travel possible even without reinforcement by a driven hank winder. It causes a vertical entry of fabric into the feed nozzle 38, and the flow of suction acting in the same direction to the blower unit 21 reinforces the entry of the fabric. Normally, the deflection roller 52 is free-wheeling. The temporary drive of the deflection roller intended when the fabric stops has the task of freely pulling the rope. This is achieved by coupling the free-wheeling deflection roller 52 to the drive motor 56 with the coupling 53.

In FIG. 6, a somewhat modified embodiment of the rope entry into the feed nozzle 38 is shown. Between the free-wheeling deflection roller 52 and the fabric entry 37, a pivotably disposed further free-wheeling guide roller 57 is provided. In the upward-pivoted position shown in solid lines in FIG. 6, the guide roller 57 does not intervene into the rope travel. On being pivoted downward into the position shown in dashed lines, it enlarges the wrap angle of the deflection roller 52, thus improving the removal of the liquor still remaining in interstices in the rope and thus reducing the amount of liquor introduced with the rope into the feed nozzle 38. Optionally, the drive of the free-wheeling deflection roller 52 can also be switched on when the rated speed is not meant to be reached. Adjusting the guide roller 57 is done by means of a pneumatic lifting cylinder indicated at 58.

FIGS. 1, 2 for instance show that the blower units 21, with the associated feed nozzles 38 and the feeding segments 43/44 of all the boxes I through VI and intermediate box 0 are located with their vertical pivot axes (18) in a common vertical plane 59 that is parallel to the longitudinal axis 9 of the container. The spacings 60 (FIG. 3) of all the pivot axes 18 from the longitudinal axis 9 of the container is thus equal. Moreover, as already noted earlier, the pivot axis 18 of each feed nozzle 38 extends in the vertical center plane 19 of the associated box. The spacings 61 between adjacent pivot axes 18 are equal as well. The pivot angle range, indicated at 62, of each feed nozzle 38 is selected such that in a first position, the feed nozzle 38 with the adjoining feeding segment 43/44 is located with its longitudinal center axis, intersecting the pivot axis 18, in the center plane 19 of the respective J-box I through VI and in the intermediate box 0 in a plane 19*a* parallel to it, which extends with the same axial spacing from the adjacent J-box side wall as does the associated J-box longitudinal center plane 19 on the side diametrically opposite the side wall 3. This setting is shown in FIG. 1.

In a second position of the feed nozzles 38, which can be set by means of suitable actuation of the lifting cylinder 51 and is located at the other end of the pivoting range 62, all the feed nozzles 38, with the associated feeding segments 43/44, are pivoted to the left in terms of FIG. 1, specifically so far that the inlet curve 44 of each feed nozzle 38 in a first J-box discharges centrally within the adjacent second J-box; that is, the rope outlet opening of the inlet curve 44 is located with its center point in the longitudinal center plane 19 of the second J-box. A rope is fed accordingly from the first J-box into the respective adjacent second J-box.

The feed nozzle 38 and the feeding segment 43/44 of the J-box VI on the left in FIGS. 2 and 3, which is adjacent to the dished boiler head 2, leads in this pivoted position, with the inlet curve 44, into a tubular scray 620 (FIG. 4), which is located in the chamber between the dished boiler head 2 and the side wall 3 adjacent to it of the J-box, and whose orifice is aligned with the orifice of the inlet curve 44 brought into this chamber. The return scray 620 discharges into a rope return tube 63, which extends along the treatment container 1 and is located outside the treatment container and which discharges at the bottom in the intermediate J-box 0 via a funnel part 631. This position of the feed nozzles 38 and the associated feeding segments 43/44 is shown in FIGS. 2, 3.

As can be seen from FIG. 3, the pivoting range 63 is embodied symmetrically to the respective transverse plane 12 extending through the corresponding pivot axis 18. Along with the oblique position of the J-box side walls 3, it is thus attained that the inlet curve 44 of each feed nozzle 38, both in the setting of FIG. 1 and in the setting of FIG. 2, always discharges centrally in the respective J-box. The center points of the rope outlet openings of the inlet curves 44 are always located in a common vertical plane 630, which extends parallel to the longitudinal axis 9 of the treatment container. Thus for both the setting of FIG. 1 and the setting of FIG. 2, the same flat-folding conditions in the J-boxes are obtained, which is of major significance for proper fabric travel.

The pivoting range 62 is adapted to the oblique position of the J-box side walls 3. It is twice as large as the angle 11, shown in FIG. 3, between the planes 12, 19.

FIG. 3, for the same treatment container diameter 64 and the same axial blower spacing 60, shows the influence of the pivot angle 62 on the J-box width 13 or 13*a*. In the left-hand part of the drawing, the pivot angle range 62 is 25°, while in the right-hand part of the drawing the pivoting range 62*a* is 30°. The result is a rated box width 13 of 700 mm, for example, at 25°, and a rated box width 13*a* of 800 mm at 30°. Accordingly, the spacing 61 of the blower units 21, or in other words of the pivot axes 18, parallel to the longitudinal axis of the treatment container 1 also increases, for instance from 740 mm for the spacing 61 to 840 mm for the spacing 61*a*. Over the full length of the treatment container 1, the blower units 21 form a row in which each blower unit is located vertically. The fabric entry is on the underside of the fabric inlet part 37 (FIG. 4) in the region of the impeller axis 18, so that excellent fabric travel properties result.

The inside of the fabric inlet part 37 to and including the nozzle part 39, is coated with PTFE or designed with PTFE.

In the mode of operation of FIG. 1, the individual J-boxes I through VI are connected parallel to one another. In each J-box, an endless rope is kept in circulation by the associated feed nozzle 38. Accordingly, single-rope treatment can be done in each one of the J-boxes.

In the setting of FIG. 2, the J-boxes I through VI are connected in series with one another in operation, so that the result is a circulation system for the circulating endless rope, which is transferred from one J-box into the respective adjacent J-box, and after the final J-box 6 in the row is returned, via the rope return tube 63, into the intermediate box 0 and from there is introduced back into the first J-box I by the associated feed nozzle. Alternatively, in this setting, the apparatus can be used as a continuous system, with a rope entering the treatment container 1 or the intermediate box 0 and exiting from the last J-box VI.

This will be briefly explained in terms of exemplary embodiments of various treatment methods below, referring to FIGS. 8, 9, which also briefly show the supplementary devices required for the treatment methods, for adding treatment agent, and so forth, in their essential parts:

FIGS. 8, 9, highly schematically, show a high-temperature piece-dyeing machine with nine J-boxes I through IX and ten blower units 21, each with an associated feed nozzle 38 and a feeding segment 43, 44 adjoining it, of which only the feed nozzle 38 is indicated, represented by a circle. Each of the J-boxes I through IX and the intermediate box 0 is assigned one such unit. The feeding segments 43, 44 are in the position of FIG. 2; that is, the machine is set for continuous circulation operation. The rope return line 63 is indicated by dashed lines. The pneumatic cylinder 51 is in the position of FIG. 2. The interior of the treatment container 1 is subdivided into three treatment zones X, Y, Z, each of which contains three J-boxes I through III, IV through VI, and VII through IX, respectively. The partitioning off of the three treatment zones from each other is effected by means of two J-box side walls 300, embodied as box partitions, which are extended in the lower segment through as far as the treatment container jacket and are connected on its inside via a sealing lip. The box partitions 300 extend upward to beyond the maximum liquor level. They are located between the J-boxes III and IV, on the one hand, and VI and VII, on the other.

The liquor pickup container 171 is also subdivided by corresponding partitions 170 into three partial containers, and each is associated with one of the treatment zones X, Y, Z. Corresponding to the three treatment zones X, Y, Z, three treatment agent injection systems are provided, which each contain one liquor filter 70, one injection pump 71, and one heat exchanger 72 for heating and cooling the treatment liquor. At 73, blocking valves, originating on the compression side of the injection pumps 71 downstream of the heat exchanger 72, are shown for the return of the treatment liquor into the part of the liquor pickup container 171 associated with the respective treatment zone X, Y, Z. The treatment liquor, kept in circulation, is pumped by the associated injection pump 71 into the respective liquor feed line 47 (FIGS. 4, 7) of the feed nozzles 38 located in the applicable group of J-boxes; in the associated lines, there are blocking valves 74 for the forward travel of the treatment liquor. An outflow fixture for each of the treatment zones X, Y, Z is shown at 75. A supply container 77 for process water, untreated water, soft water, and hot water (at approximately 60° C.), or initial liquor containers for treatment baths, communicate with the suction side of the injection pumps 71, each via a respective blocking fixture 74. Two initial liquor and replenishing liquor containers 78 for treatment liquor are also provided, each of which can made to communicate with the suction side of the injection pumps 71 via a blocking valve 79. The blocking valves 79 and the associated line connections are shown for only one of the initial liquor and replenishing liquor containers. A steam source is indicated at 80; downstream of it are a condensate diverter 81, a reducing valve 82, and a regulating valve 83, and this source makes it possible to subject the interior of the treatment container 1 to steam directly. Finally, switchover/blocking armatures are also shown at 84, on the suction side of the injection pumps 71.

Exemplary Embodiment 1

In the high-temperature piece-dyeing machine, with nine J-boxes I through IX, an alkaline hydrogen peroxide bleaching is performed on a knitted cotton product with an interlock binding, as prebleaching for a subsequent reactive dyeing operation. The interlock product has a tubular width of 80 cm, not cut open. The weight per unit of surface area is 190 g/m$^2$ and is equivalent to a running meter weight of 300 g/m, which for a batch weight of nine times 150 kg per box is equivalent to a total batch of 1350 kg, for a fabric length of 4500 m.

For a fabric thickness of 0.8 mm, this batch is equivalent to a volume Vtex of 5.76 $m^3$ and a substrate volume VS of 6.0 $m^3$, which corresponds to an intermediate chamber volume VZ of 4.86 $m^3$. For an average liquor load of 80%, this volume is 3.89 $m^3$.

For preparing for loading the machine, the total batch is in three connected pieces, each of 1500 m.

In the initial liquor container 77, the treatment bath for the prebleaching has been set at 2500 l at 50° C.

The bath contains a wetting agent, 32.5% caustic soda, 35% hydrogen peroxide, and an additive of a bleach stabilizer.

Loading of the machine with the total batch:

The pneumatic cylinder 51 (FIG. 2) is put into the circulation system position of FIG. 2. It is also triggered by a control unit 85 such that it imparts a reciprocating traversing motion over the J-box width to the thrust rod 49 and thus to the inlet curves 44, so that the feeding segment 43, with the inlet curve 44, functions as a rope piler for each J-box. For monitoring the loading operation, all the stoppers 15 in the region of the blower units 21 are opened.

Since the blower units 21 are designed with a fabric inlet 37 and nozzle part 39 for self-aspiration of the rope, forward feeding pieces or belts are unnecessary for the loading operation.

For loading the treatment container 1, the beginning of the rope leading from the three piles of fabric is introduced at the stopper 15 of the blower unit 21 of the intermediate box 0 of the J-box III and the J-box VI, and the end of the rope of the three piles of fabric is secured to the same stoppers, so that after the entry, the end of the rope is secured. After the blower unit 21 of the J-box 0 is switched on, this blower unit draws the first rope in. With a delay of approximately 5 seconds, the blower units of the J-boxes III and VI are then switched on, so that the three ropes enter the J-boxes I, IV and VII parallel to one another. For reinforcing the fabric travel in the box, the blower on the outlet side of the entering J-box is also switched on in each case. The blower units 21 of the next J-boxes are switched on with a corresponding time lag.

The injection nozzles 45 (FIG. 4) are subjected to treatment liquor via the injection pump 71, connected to the applicable group of J-boxes, with an open communication with the initial liquor container 77.

After the entry of the ropelike tubular fabric, the various blower units 21 involved and the blocking valves 74 connected to them switch off. The incoming rope ends that have arrived at the stoppers 15 of the J-boxes III, VI, or the intermediate box 0, are now stitched together with the trailing ends of the respective adjacent rope, creating an endless rope with three seams. The stoppers 15, from each of which the entry of the textile goods into the corresponding blower unit 21 has been monitored, are closed.

As a consequence of the setting of the blower units 21 and the feeding segments 43/44 to circulation system operation and the switching on of the traversing motion of the inlet curves 44, with the blower units 21 and injection pumps 72 switched on, the initial liquor bath arriving from the opened initial liquor container 77 is distributed uniformly over the goods. The blower units 21 are regulated to a fabric circulation speed of 400 m/min.

By monitoring the level in the liquor pickup container 17, after the initial liquor bath has been introduced from the initial liquor container 77 via the valves 73, 74, the level in the treatment container 1 is corrected. The treatment liquor is kept constant at 60° C. for 10 minutes and then, with a gradient of 6° C. per minute, upon switching on of the direct steam from the steam source 80, is heated to a treatment temperature of 90° C., which is maintained for 20 minutes.

During this time, the first rinsing bath is prepared, with a bath volume of 2500 l at 80° C., in the initial liquor container 77.

The treatment bath (bleach bath) in the treatment container 1 is drained off after 20 minutes by opening a ventilation valve 90 and the drain valves 75, and the first rinsing bath is distributed via the injection pumps 71 over the ropes of the three groups of J-boxes in the treatment zones X, Y, Z.

The rinsing water dripping off in the J-boxes gets into the liquor pickup container 17 and is reaspirated by the injection pumps 71 via the switchover fixtures 84.

The circulation rinsing is maintained for 5 minutes.

Within this time, the second rinsing bath is prepared in the initial liquor container 77, with 2500 l of rinsing water at 60° C., with the addition of acetic acid to neutralize a product against any possible residual concentration of hydrogen peroxide. After the first rinsing bath has been drained off, the second rinsing bath is carried through the three groups of J-boxes on the counter current principle; the exit from the first group of boxes that includes the J-boxes VII, VIII, and IX is via the respectively associated switchover fixture 84 and injection pump 71 into the second group of J-boxes IV, V, VI and after passing through them is pumped into the third group of J-boxes I, II, III, after which it is carried into the drain. In this counter current course, the rinsing water temperature is kept constant at 60° C., since the subsequent reactive dyeing is done at a constant temperature of 60° C.

For the 3.5% reactive dyeing that is planned after the alkaline hydrogen peroxide bleaching is performed, after constant-temperature dyeing at 60° C., the nonfixed reactive dye is washed out with simultaneous neutralization of the residual chemicals from the dye bath.

The rinsing cycle is more comprehensive and thus more time-consuming than the peroxide bleaching cycle described above.

To shorten the total processing time, boxes can be divided into groups of different numbers of boxes, for instance from one to four boxes, and staggered rinsing segments can be employed, so that based on the sequence of rinsing segments, simultaneous action can be exerted on the textile goods by the rinsing baths having a different rinsing temperature and a different residual concentration.

The breakdown of the rinsing cycle, in reactive dyeing that is given here as an example, is such that with a first rinsing bath at 50° C. and circulation of the bath, an equalization of concentration is accomplished; a second bath at 50° C. is provided on the counter current principle for neutralization; and then, also with offset use at a rinsing temperature of 85° C., hot rinsing is done to neutralize the residual alkali, and the direct steam from the steam source 80 can also be switched on. To speed up the washing out process, a further injection nozzle (not shown in the drawing) is switched on, which is aimed at the surface of the incoming, deposited rope in the segment of the box.

After the hot rinsing, after the same course of events, two initial rinsing bath liquors at 50° C. and one initial rinsing bath liquor at 30° C. on the counter current principle with offset connection are performed; that is, after passage through the first group of boxes, and the switchover to the second group of boxes, the next subsequent rinsing bath can already be switched over to the first group of boxes.

Once the rinsing liquor has been drained from the last rinsing bath, the rope is stopped at box IX after a seam sensor 87 (FIG. 4) reports a seam. The rope is cut apart, and the piece located counter to the fabric travel direction is carried out of the J-box IX through the stopper 15 and deposited, via a discharge hank winder, in a rotary carriage. The blower units 21 of the J-boxes that have become empty upon discharge switch off automatically.

Exemplary Embodiment 2

The high-temperature piece-dyeing machine shown in FIG. 9, with nine J-boxes, is equivalent in principle to the high-temperature piece-dyeing machine shown in FIG. 8. Identical parts are therefore identified by the same reference numerals and not explained again. In addition to the machine of claim 8, in the machine of FIG. 9, devices for subjecting the treatment container 1 to superheated steam from a steam source 90 and for suction extraction of the mixture of steam and air from the treatment container 1 are also provided. The steam source 90 is followed, via a condensate diverter 91 and a reducing valve 92, by a steam superheater 93, which is adjoined via a regulating valve 94 by a two-way fixture 95, which makes it possible selectively to subject the treatment container interior and, via a tubular distribution indicated at 96, the feed nozzles 38 of the individual blower units 21 to superheated steam.

The suction extractor of the mixture of air and steam from the treatment container interior has a suction extraction blower 97, which communicates with the treatment container interior via a gas cooler 98 and a gas moisture separator 99. The suction extraction blower 97 makes it possible to generate a maximum underpressure for instance of about 0.5 bar absolute.

In the high-temperature piece-dyeing machine of FIG. 9, dispersion dyeing on textured polyester can for instance be done in the form of isothermic dyeing with reductive post-cleaning.

For this dispersion dyeing, a polyester knitted fabric 25% Trevira®350 and 75% Trevira®76/1 is used, specifically in the form of tubular fabric fresh from the loom with a tube width of 90 cm and a weight per unit of surface area of approximately 110 g/m$^2$, corresponding to a running meter weight of approximately 200 g/m, which is equivalent to a batch weight of 9 times 140 kg per J-box in a total batch of 1260 kg, for a fabric length of 6300 m. For preparing the machine loading, the total batch is in three connected pieces, each 2100 m long.

Loading the treatment container 1 with the goods is done in the same way as in Example 1.

Next, at a fabric speed of approximately 500 m/min, the goods are exposed for 15 minutes to a washing liquor, used as a prewash, at a temperature of 60° C. After the washing liquor is drained off and after a waiting time of 1.5 minutes to let the fabric package drip, intermediate rinsing of the batch is done at approximately 60° C., with a washing liquor from the initial liquor container 77.

After that, the treatment bath, which is prepared with chemicals and additives and contains equalizing additives and sodium acetate as well as acetic acid to adjust the pH, is heated to 86° C., and after the intermediate rinsing liquor has been drained off is distributed via the injection nozzles 45 to the running fabric, specifically with uniform heating at a gradient of 5°/minute, with the addition of the direct superheated steam from the steam source 90; the switchover fixture 95 is set such that the superheated steam flows into the treatment container interior. The goods are heated to the injection temperature of the dye, which in this example is set at 115° C.

Next, the dyeing of the goods is done by a procedure known per se, followed by reductive postcleaning with subsequent rinsing on the counter current principle. After the conclusion of the rinsing events and the draining off of the rinsing liquor, the rope is cut at a seam in the J-box IX and removed from the treatment container in the manner already explained.

Exemplary Embodiment 3

With the high-temperature piece-dyeing machine of FIG. 9, after an already-performed reactive dyeing, for instance on knitted cotton fabric, and after the washing and rinsing process in the circulation system, a subsequent drying stage can be performed.

To that end, the following treatment steps are performed in the machine:

1. Heating the textile goods and loading the liquor, including the treatment container 1 and the structural components located in it.

After the blower units 21 involved in the circulation of the rope are switched on and the deflection rollers 52 have been driven, the pivotably disposed guide roller 57 is made to press against the rope via the pneumatic cylinder 58 (FIG. 6). By means of the traversing motion of the inlet curves 44, generated by the pneumatic cylinder 51 (FIG. 2), a proper disposition of ropes in the J-boxes I through IX for the circulation mode is assured.

By switching on the direct delivery of steam from the steam source 80, fast heating of the goods to a temperature of approximately 110° C. takes place. After about 10 minutes, the supply of steam is interrupted, and the pivotable guide roller 57 is pivoted upward into the outset position. Simultaneously, the drive of the deflection roller 52 is switched off, and the drive of the blower units 21 is regulated upward to a fabric circulation speed of 400 m/min.

2. To generate an evaporation phase with simultaneous reduction of the dampness of the goods, the direct steam with superheating from the steam source 30 is now switched to the feed nozzles 38 at an inflow temperature of 150° C., via the suitably set two-way switchover fixture 95. With the outflow fixtures 75 closed, the suction extraction blower 97 is switched on, and the gas cooler 98 is regulated to an exit temperature of 50° C. This treatment step is maintained for 20 minutes.

3. For cooling the batch down, after the superheated steam has been blocked off and the ventilation fixture 90 has been opened, it is attained that through the suction extraction blower 97, fresh air is aspirated and the batch is cooled down to approximately 40° C.

Next, the rope is cut at the J-box IX and removed from the treatment container 1 in the manner already described.

The invention claimed is:

1. A method for treating ropelike textile goods in a closed container that contains at least two axially adjacent J-boxes for receiving textile goods during at least part of a treatment time, in which a driving motion in a feeding direction is imparted to the textile goods, by means of a gaseous flow of feeding medium made to act on the rope via feed nozzle means; and in which the textile goods, before entering each J-box, pass through separate feed nozzle means assigned to that J-box, and upon exiting from these feed nozzle means are introduced selectively into the respective associated first J-box or a second J-box adjacent to this J-box, or in the case of at least one J-box are conducted along a predetermined path, which carries the textile goods away from this J-box.

2. The method of claim 1, characterized in that in each J-box, its own endless rope is kept in circulation for at least part of the treatment time.

3. The method of claim 1, characterized in that an endless rope, each from one J-box, is conducted into a J-box adjacent to it and after traveling through this J-box and optionally through at least one further J-box is returned to the first J-box mentioned again, and the endless rope is set into circulation by the feeding means, through which it passes, of the individual J-boxes.

4. The method of claim 1, characterized in that the textile goods are treated in at least two treatment zones, which are embodied separately from one another in the treatment containers, and of which each treatment zone contains at least one J-box.

5. The method of claim 4, characterized in that in at least two of the treatment zones, different treatments from one another of the rope are performed.

6. The method of claim 5, characterized in that treatment agent from the first treatment zone is introduced into another, second treatment zone, and during the treatment in the second treatment zone, the first treatment zone is simultaneously supplied with treatment agent again.

7. The method of claim 1, characterized in that the flow of feeding medium for the feeding means of each J-box is generated with separate blower means for that J-box.

8. An apparatus for treating ropelike textile goods, having a closable treatment container;

at least two J-boxes located side by side in the treatment container, for receiving the textile goods during at least part of the treatment time;

feeding means, for feeding the textile goods, that have feed nozzle means through which the textile goods pass, with a rope inlet and a rope outlet, which can be acted upon by a gaseous feeding medium that imparts a feeding motion to the textile goods;

devices for causing a treatment agent to act on the textile goods in the treatment container;

wherein each J-box is assigned its own feed nozzle means, and the feed nozzle means are embodied adjustably such that their rope outlet leads selectively into the respective associated first J-box or from at least one J-box into a second J-box adjacent to it, or into a device that receives an exiting rope.

9. The apparatus of claim 8, characterized in that the feed nozzle means of each J-box are each assigned their own blower.

10. The apparatus of claim 9, characterized in that the blower is placed on the treatment container in the region of the top side thereof.

11. The apparatus of claim 9, characterized in that the blower, is located with a substantially vertical blower impeller axis.

12. The apparatus of claim 9, characterized in that the blower has a suction stub, opening into the treatment container, and a compression stub coaxial with it, which communicates with the respective feed nozzle means.

13. The apparatus of claim 8, characterized in that the feed nozzle means of the individual J-boxes are supported pivotably about axes of rotation parallel to one another.

14. The apparatus of claim 13, characterized in that the feed nozzle means each have one feeding segment for a rope, which ends in the respective rope outlet and which is pivotable with the feed nozzle means.

15. The apparatus of claim 14, characterized in that the feeding segment is embodied as a rope piler.

16. The apparatus of claim 13, characterized in that it has a pivoting device, which is coupled with the feed nozzle means of the J-boxes and by which the feed nozzle means are pivotable.

17. The apparatus of claim 16, characterized in that the pivoting device is arranged for laying a rope emerging from the rope outlet upon its entry into the respective associated J-box.

18. The apparatus of claim 8, characterized in that the devices for causing a treatment agent to act on the textile goods have flexible line means for the treatment agent, which discharge into injection nozzles of the feed nozzle means of the individual J-boxes.

19. The apparatus of claim 8, characterized in that it has a rope returning device, which is arranged for receiving the rope emerging from the rope outlet of the feed nozzle means of at least one J-box, and by which a rope return path to a J-box preceding it in the rope feeding direction is embodied.

20. The apparatus of claim 19, characterized in that the rope returning device has an intermediate box for the returned rope.

21. The apparatus of claim 19, characterized in that the rope returning device has a pipeline extending along the treatment container, which can be coupled on one end to the rope outlet of the feed nozzle means of a J-box and which on its other end discharges into a chamber of the treatment container.

22. The apparatus of claim 8, characterized in that the J-boxes, defined by each two side walls axially spaced apart from and diametrically opposite one another, in the treatment container are located extending obliquely to the longitudinal axis of the treatment container.

23. The apparatus of claim 22, characterized in that the J-box side walls form an angle of approximately 80° to 50°, preferably from 65° to 60°, with the longitudinal axis of the treatment container.

24. The apparatus of claim 22, characterized in that the J-boxes are embodied in a friction-reducing way on the inside of their side walls and on a bottom wall that connects the side walls to one another.

25. The apparatus of claim 22, characterized in that the feed nozzle means of the individual J-boxes have a pivot angle region which is equal to twice the angle that the J-box side walls each form with a plane that extends perpendicular to the longitudinal axis of the treatment container.

26. The apparatus of claim 25, characterized in that the pivot axes of the feed nozzle means of the individual J-boxes are located at the same radial spacing from the longitudinal axis of the treatment container.

27. The apparatus of claim 8, characterized in that the treatment container is subdivided by partitions, which in sealed fashion adjoin the inner wall of the treatment container over a portion of the circumference of the partitions, into treatment zones, each of which contains at least one J-box.

28. The apparatus of claim 8, characterized in that the J-boxes are assigned sensors that detect their fill status, and the blowers of the J-boxes are assigned a control unit, which receives signals output by the sensors and controls the throughput of feeding medium by means of the individual blowers.

29. The apparatus of claim 8, characterized in that the treatment container communicates with a treatment agent collection vessel.

* * * * *